US009933139B2

(12) United States Patent
Skergeth et al.

(10) Patent No.: US 9,933,139 B2
(45) Date of Patent: Apr. 3, 2018

(54) LIGHT FIXTURE COMPRISING INTERCHANGEABLE LIGHTING MODULES

(71) Applicant: ZUMTOBEL LIGHTING GMBH, Dornbirn (AT)

(72) Inventors: Sascha Skergeth, Lustenau (AT); Michael Kohler, Dornbirn (AT); Thomas Kottek, Lustenau (AT); Cristian Olariu, Dornbirn (AT); Norbert Peter, Hohenems (AT); Sebastian Schubnell, Kressbronn (DE); Daniel Steurer, Sibratsgfäll (AT)

(73) Assignee: ZUMTOBEL LIGHTING GMBH (AT)

( * ) Notice: Subject to any disclaimer, the term of this patent is extended or adjusted under 35 U.S.C. 154(b) by 0 days.

(21) Appl. No.: 15/122,482

(22) PCT Filed: Mar. 2, 2015

(86) PCT No.: PCT/EP2015/054253
§ 371 (c)(1),
(2) Date: Aug. 30, 2016

(87) PCT Pub. No.: WO2015/132179
PCT Pub. Date: Sep. 11, 2015

(65) Prior Publication Data

US 2017/0074495 A1 Mar. 16, 2017

(30) Foreign Application Priority Data

Mar. 3, 2014 (DE) ..... 20 2014 100 948 U

(51) Int. Cl.
*F21S 4/00* (2016.01)
*F21V 19/00* (2006.01)
(Continued)

(52) U.S. Cl.
CPC ..... *F21V 19/004* (2013.01); *F21S 8/061* (2013.01); *F21V 15/01* (2013.01); *F21V 21/008* (2013.01);
(Continued)

(58) Field of Classification Search
CPC .... F21V 19/004; F21V 23/001; F21V 23/007; F21V 23/02; F21V 23/06; F21Y 2103/10; F21Y 2115/10
(Continued)

(56) References Cited

U.S. PATENT DOCUMENTS 7,575,338 B1 * 8/2009 Verfuerth ..... F21S 8/06 362/148
8,104,920 B2 * 1/2012 Dubord ..... F21S 2/005 362/217.12
(Continued)

FOREIGN PATENT DOCUMENTS

DE 102007044566 3/2009
DE 202010006329 9/2010
(Continued)

OTHER PUBLICATIONS

German search report on priority application DE 20 2014 100 948.5 dated Sep. 24, 2014.
(Continued)

*Primary Examiner* — Paultep Savusdiphol
(74) *Attorney, Agent, or Firm* — Andrus Intellectual Property Law, LLP

(57) ABSTRACT

The invention relates to a light fixture (1) comprising an elongated carrier element (5), a number of lighting modules (20), which can be detachably secured to the carrier element (5), and means for supplying power to the lighting module (20), said means comprising an operating device (100) and contacting means (40, 41) which are connected to said
(Continued)

operating device (100) and to which the lighting modules (20) can be electrically connected. In said light fixture, the operating device (100) and the contacting means (40, 41) are arranged on a device carrier (50) that can be detachably secured to the carrier element (5).

9 Claims, 5 Drawing Sheets

(51) Int. Cl.

| | |
|---|---|
| ***F21V 15/01*** | (2006.01) |
| ***F21V 23/00*** | (2015.01) |
| ***F21S 8/06*** | (2006.01) |
| ***F21V 21/008*** | (2006.01) |
| ***F21V 23/02*** | (2006.01) |
| ***F21V 23/06*** | (2006.01) |
| *F21S 8/04* | (2006.01) |
| *F21Y 113/00* | (2016.01) |
| *F21Y 103/10* | (2016.01) |
| *F21Y 115/10* | (2016.01) |

(52) U.S. Cl.
CPC ..... *F21V 23/001* (2013.01); *F21V 23/007* (2013.01); *F21V 23/02* (2013.01); *F21V 23/06* (2013.01); *F21S 8/04* (2013.01); *F21Y 2103/10* (2016.08); *F21Y 2113/00* (2013.01); *F21Y 2115/10* (2016.08)

(58) Field of Classification Search
USPC .. 362/219, 221, 225, 217.1, 217.12, 217.13, 362/217.14, 217.16, 217.17
See application file for complete search history.

(56) References Cited

U.S. PATENT DOCUMENTS

| | | | | |
|---|---|---|---|---|
| 8,581,513 | B1 | 11/2013 | Reinoso | |
| 9,046,232 | B2 * | 6/2015 | Melzner | F21S 2/005 |
| 2001/0036070 | A1 * | 11/2001 | Compagnucci | A47B 77/00 362/127 |
| 2006/0039168 | A1 * | 2/2006 | Mier-Langner | F21S 8/038 362/648 |
| 2006/0262545 | A1 | 11/2006 | Piepgras et al. | |
| 2009/0218923 | A1 | 9/2009 | Gingrich et al. | |
| 2009/0296381 | A1 * | 12/2009 | Dubord | F21S 2/005 362/218 |
| 2011/0075413 | A1 * | 3/2011 | Smith | F21S 2/00 362/235 |
| 2012/0002413 | A1 * | 1/2012 | Kim | F21S 2/005 362/235 |
| 2012/0113634 | A1 * | 5/2012 | Wong | F21V 21/005 362/235 |
| 2012/0127702 | A1 * | 5/2012 | Lax | F21S 8/043 362/184 |
| 2013/0020941 | A1 | 1/2013 | Breidenassel | |
| 2013/0114262 | A1 * | 5/2013 | McClellan | F21S 2/005 362/249.03 |
| 2014/0049954 | A1 | 2/2014 | Ladstaetter | |
| 2015/0300574 | A1 | 10/2015 | Preuschl et al. | |

FOREIGN PATENT DOCUMENTS

| | | |
|---|---|---|
| DE | 102010030702 | 10/2011 |
| DE | 102011017702 | 10/2012 |
| DE | 102012202148 | 8/2013 |
| DE | 102012202353 | 8/2013 |
| DE | 112011104384 | 10/2013 |
| EP | 1045201 | 10/2000 |
| EP | 2151899 | 2/2010 |

OTHER PUBLICATIONS

Austria search report on co-pending Austria application GM 338/2014 dated Aug. 27, 2015.
International Search Report for parent PCT Application PCT/EP2015/054253 dated May 21, 2015.

* cited by examiner

LIGHT FIXTURE COMPRISING INTERCHANGEABLE LIGHTING MODULES

CROSS REFERENCE TO RELATED APPLICATION

The present application is the U.S. national stage application of International Application PCT/EP2015/054253, filed Mar. 2, 2015, which international application was published on Sep. 11, 2015 as International Publication WO 2015/132179 A1. The International Application claims priority of German Patent Application 20 2014 100 948.5 filed Mar. 3, 2014.

FIELD OF THE INVENTION

The present invention relates to a light fixture, which has an elongated carrier element, to which numerous lighting modules can be detachably secured.

BACKGROUND

The idea of arranging lighting modules on a carrier element such that they are interchangeable is known in particular from so-called strip light systems. These are lighting systems having an elongated carrier element, e.g. a U-shaped mounting rail open toward the bottom, running in or on the electrical lines for supplying electrical current, as well as for signal transmission, if applicable. Depending on the design of the system, lighting modules can then be arranged at specific, predefined positions, or freely at arbitrary locations of the mounting rail. Each lighting module has special contact elements—e.g. in the form of so-called rotary toggles—which produce a mechanical attachment to the mounting rail on one hand, and also ensure contact to the electrical lines on the other hand. Furthermore, the lighting modules normally each have their own operating device, which converts the network supply voltage, provided via the electrical lines running along the mounting rail, into a suitable operating voltage for operating the light sources of the lighting modules.

A detachable arrangement of individual modules, each of which contain light sources, would also make sense with individual light fixtures, in particular when the light sources that are to be used are LEDs. In comparison with conventional light sources such as incandescent bulbs or fluorescent lamps, the replacement of defective LEDs or defective LED boards is normally difficult to carry out for the end user, such that in the event of such a defect, either the light fixture must be replaced or sent to the manufacturer, or repairs must be made by a trained electrician. This is because, for safety reasons, LED boards are normally incorporated in light fixtures such that they are difficult to access. One reason for this is that the danger of electric shocks is eliminated or at least reduced. Furthermore, an unintentional touching of an LED board may lead to so-called ESD damage, i.e., damage attributable to an undesired electrical discharge. As a result, LED light sources in light fixtures are normally arranged in specially protected or encapsulated ways, and access to the boards can frequently only be obtained by destroying certain components, which comprise such a protection.

There are ways to avoid the problems described above, in which the LEDs are provided in special encapsulated modules that are detachably secured to the light fixture, and are electrically coupled thereto using appropriate means for providing current. In the case of a defective LED, instead of replacing the specific board on an individual basis, the entire module is replaced, which normally can also be relatively easily carried out by the end user.

SUMMARY OF THE INVENTION

The present invention addresses the fundamental problem of simplifying the construction of a light fixture of the type described above, having interchangeable lighting modules. In particular, an assembly of the light fixture with regard to the means for supplying power to the lighting modules is to be simplified.

This objective is achieved by means of a light fixture having the features discussed herein.

The light fixture according to the invention has, as described above, an elongated carrier element, on which numerous lighting modules can be detachably secured. Furthermore, means for supplying power to the lighting modules are provided, wherein these means comprise an operating device as well as contacting means connected to the operating device, to which the lighting modules can be electrically connected. The operating device and the contacting means are arranged on a device carrier according to the invention, which preferably can be detachably secured to the carrier element as a pre-assembled component.

As a result of the solution according to the invention, the production of the light fixture, or its assembly, is significantly simplified. Because all of the main components for the electrical power supply to the interchangeable lighting modules are disposed on the device carrier, this device carrier can first be populated with the appropriate components. Subsequently, only the arrangement of the device carrier on the carrier element for the light fixture is required. A complicated laying of individual cables for providing the individual power supply to the individual lighting modules is eliminated in this regard, such that the light fixture seen as a whole has a very clear construction. Maintenance or repair work pertaining to the power supply means for the lighting modules is likewise simplified.

The device carrier is disposed, according to a preferred embodiment of the invention, on the side of the carrier facing away from the lighting modules, wherein the contacting means then pass through holes formed in the carrier element. The lighting modules are thus secured to the carrier element from the undersurface thereof, or the light emitting surface, respectively, while in contrast, the device carrier is disposed on the carrier element on the opposite side thereof, and snapped onto it, or locked in place thereon. This design also contributes to improving potential maintenance work by the end user, because when replacing individual defective lighting modules from the light emitting side thereof, with the exception of the contacting means, all of the other means for power supply are protected, and there is no danger that these means will be touched unintentionally.

The contacting means are preferably not directly disposed on the device carrier, which itself is formed by an appropriately shaped sheet metal component, but rather, are disposed on so-called connecting boards. These in turn are detachably secured on the device carrier, and exhibit, on one hand, the contacting means, as well as, on the other hand, means for establishing an electrical connection to the operating device for the light fixture. These means for the electrical connection can comprise a simple plug or a clamp, by means of which a connection to the operating device is obtained using an appropriate cable. The contacting means for producing the electrical connection to the corresponding lighting module are then connected to the plug or clamp, respectively, via conductor paths formed on the connecting board for example. Preferably, there are numerous contacting means on each of the connecting boards, e.g. two contacting means. These contacting means can, for example, be plugs or sockets for an electrical plug-in system, which then interact with a suitable counterpart located on the lighting module. It is particularly preferred that the contacting means are formed, however, by simple contact elements, in particular spring contacts. When a lighting module is disposed on the carrier element for the light fixture, these end up in a corresponding contact with the contacts located on the lighting module, and ensure the electrical supply to the lighting module.

According to the preferred further development of the invention described above, there are thus numerous connecting boards disposed on the elongated device carrier, wherein each of the connecting boards is then connected to the operating device via cables. It is particularly preferred that an appropriately designed cable harness is used, which is coupled at one end to the operating device, and to the various connecting boards at the other end. The individual electrical lines of the cable harness are of different lengths, and are sized in particular such that their lengths basically correspond to the spacing between the connecting boards, or the distance of the plug/clamp on the connecting board to the operating device. This means that the cable harness has cables formed specifically with respect to their length, corresponding to the position of the board that is to be supplied with power, such that an extremely clear wiring is ensured. This can be further optimized, or improved, in that the cables are laid out in an intermediate space between the connecting boards and the device carrier, extending to the connecting board that is to be connected thereto.

Lastly, a very clear modular construction for the light fixture is thus obtained by means of the solution according to the invention, by means of which repair or maintenance work is significantly simplified. The construction according to the invention also enables, in a simple manner, light fixtures of different dimensions, and accordingly, having different numbers of interchangeable lighting modules, to be made available.

BRIEF DESCRIPTION OF THE DRAWINGS

The invention shall be explained in greater detail below, based on the attached drawings. Therein.

DETAILED DESCRIPTION

Figure 2:
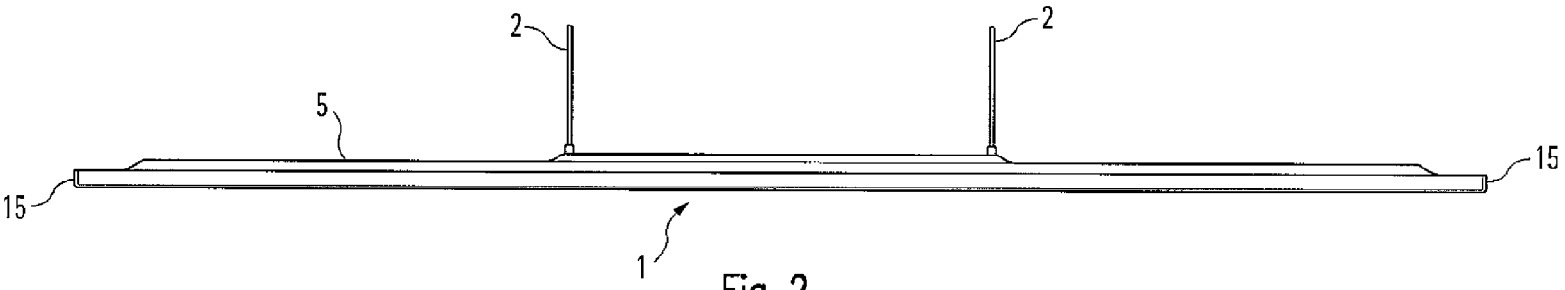
FIG. 2 shows a side view of the light fixture according to the invention.
Figure 1:
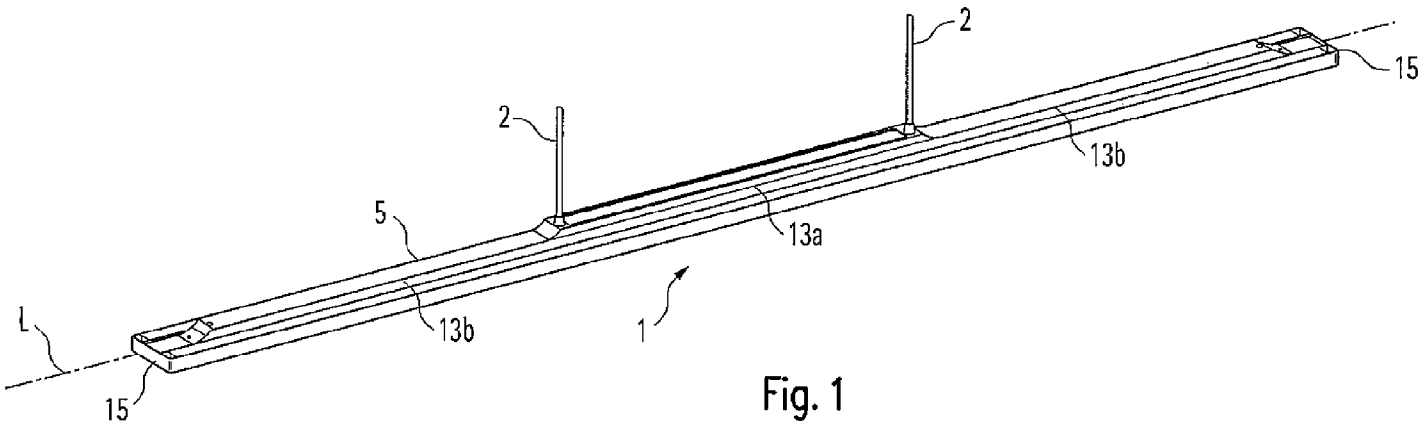
FIG. 1 shows a light fixture according to the invention in a perspective view, diagonally from above.

FIGS. 1 and 2 show different views of the light fixture, indicated as a whole with the reference symbol 1. The light fixture 1 is designed as a suspended lamp in the depicted exemplary embodiment, and can, in this case, be suspended from the ceiling of a room, for example, via at least one suspension element; in the depicted case, via numerous cords 2 on a (not shown) carrier element. In a slightly modified manner, the light fixture 1 according to the invention could, however, also be used as a light fixture installed in a ceiling.

As can be seen in the figures, the light fixture 1 as a whole has an elongated design, and extends thereby along a longitudinal axis L. The shape of the light fixture 1 is established, primarily by a carrier element 5, which represents the central element of the light fixture 1, and on which all of the other components are disposed, or secured, respectively. A substantial feature of this carrier element 5 is that it forms a receiving region having a U-shaped cross section on its undersurface, or its light emitting surface, respectively, which shall be described in greater detail below, in which numerous lighting modules can be interchangeably arranged. The carrier element 5 is preferably formed by an aluminum profile, which is closed at both ends by end caps 15, which in turn are detachably secured to the carrier element 5.

Figure 6:
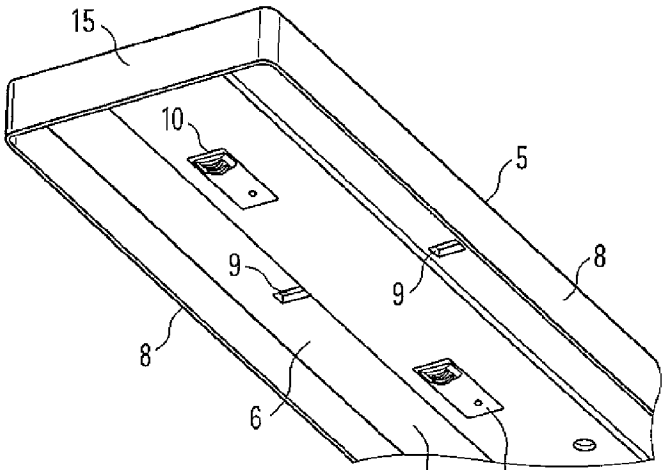
FIG. 6 shows a perspective view of an end region of the carrier element for the light fixture.

FIG. 6 shows the end region of the carrier element 5 from below, wherein the receiving region 6 for the interchangeable lighting modules can be seen. This receiving region is formed by a base surface 7 as well as two U-legs 8 pointing downward, running on both sides of the base surface 7. As a result, the receiving region 6, together with the aforementioned end elements, or closure caps 15 is formed as a whole as an elongated trough having a U-shaped cross section. Numerous lighting modules—14 lighting modules in the depicted exemplary embodiment—are then disposed therein, wherein one of them is shown in a perspective view in FIG. 5.

The lighting module 20 thus has a basically rectangular shape. As can be derived in particular from the sectional views in FIGS. 7 and 8, the lighting module is composed of a trough-like lens mount 21, formed by a translucent or transparent material, having a base surface 22, which forms the light emitting surface of the lighting module 20, and four side walls 23, 24. Two snap-in lugs 25 are formed on each of the two shorter side walls 24 and are used to secure the light fixture 1 to the carrier element 5. As can be derived from the depiction in FIG. 6, corresponding snap-in holes, or slits 9 are formed for this in the base surface 7 of the receiving region 6 of the carrier element 5, in which the snap-in lugs 25 of the lighting module 20 can engage in a latching manner.

Figure 7:
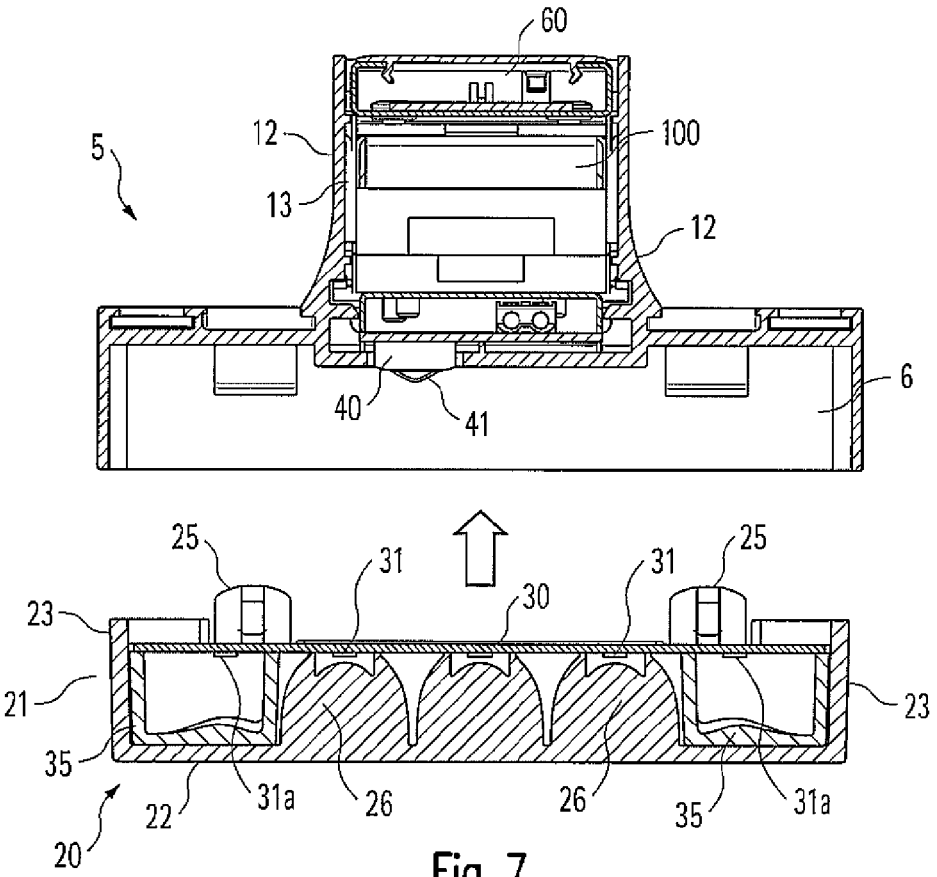
FIG. 7 shows a sectional view of the light fixture, transverse to the longitudinal axis, wherein the interchangeable lighting module is disposed at a spacing to the carrier element.

The base surface of the lighting module 20 is formed by the back surface of a board 30 having numerous LEDs 31 disposed thereon, preferably in the manner of a matrix (see FIG. 7). These LEDs 31 represent the light sources for the lighting module 20, wherein the LEDs 31 may be assigned to different optical means that have an effect on the light emission.

Figure 4:
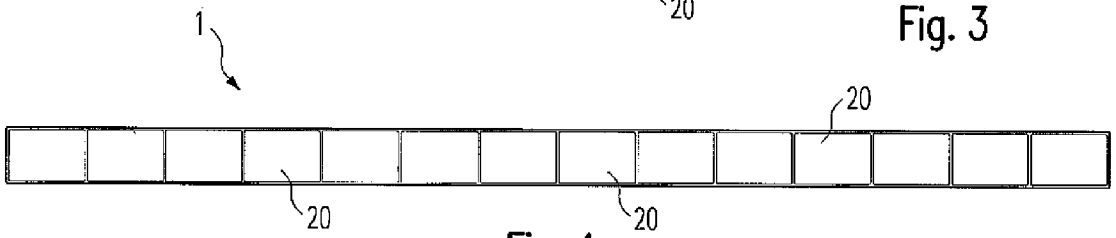
FIG. 4 shows a view of the light fixture according to the invention from below.

As can be seen in FIG. 7, lenses 26 are formed in the depicted exemplary embodiment in the central region of the lens mount 21, which are assigned to respective individual LEDs 31. The light from the LEDs located on the edges, in contrast, is not emitted such that it is guided by lenses, but instead, should elicit a basically diffused, encompassing illumination frame. This is achieved by means of a special diffusion frame 35, which is placed in the lens mount 21, and in comparison to the lens mount 21, which is preferably made of a transparent material, is formed by a diffusing material, or contains light diffusing particles, respectively. It should be noted, however, that as a matter of course, the design of the optical elements for the individual lighting modules 20 can also differ therefrom, if another type of light emission is desired. The design of these optical elements is of no greater relevance for the fundamental concept of the present invention. The important thing, however, is that numerous lighting modules 20 are secured to the carrier element 5 for the light fixture 1, such that an appearance of the undersurface, or the light emitting surface, respectively, of the light fixture 1, such as that depicted in FIG. 4, is obtained in this regard.

The LED board 30 forming the back surface of the lighting module 20 is locked in place on the lens mount 21. Corresponding latching elements 27 for this are formed on the two side walls 23, which interact with the board 30 such that, in a simple manner, they can be placed from behind on the open lens mount 21 and then removed therefrom by pressing against them. In this manner, a stable component is formed, by means of which, in turn, the individual LEDs 31 are efficiently protected against external effects.

The power supply for the lighting modules 20 disposed on the carrier element 5 is obtained using special contacting means, which comprise spring contacts 41 in the depicted exemplary embodiment, which interact with the contact panels 35 disposed on the back surface of the LED board 30. The spring contacts 41 are each disposed here on a contact block 40 that can be seen in FIG. 7, which extends through a corresponding hole 10 in the base surface 7 of the receiving region 6 of the carrier element 5. This means that these spring contacts 41 can be accessed from the receiving section 6 of the carrier element 5 such that they come in contact with the contact panels 35 of the lighting module 20 when the lighting module 20 is placed in the receiving region 6. As a result, the electrical connection between the spring contacts 41 and the lighting module 20 is ensured, such that these—as shall be explained in greater detail below—are connected to the actual means for providing an operating current for the LEDs 31.

Figure 5:
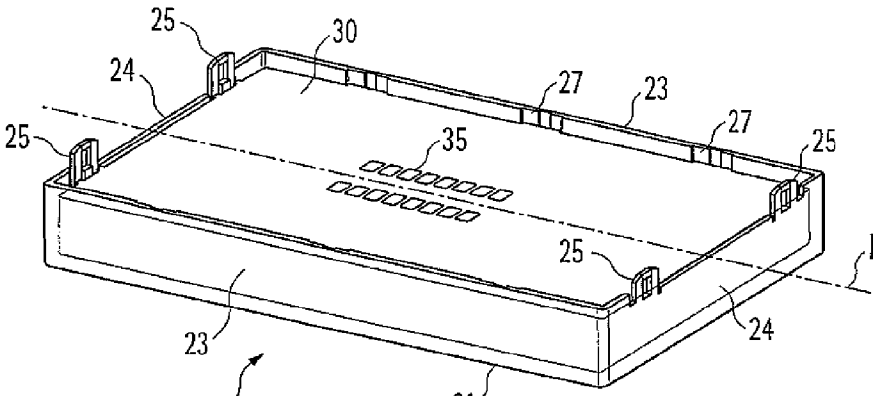
FIG. 5 shows a lighting module that is to be interchangeably secured to the light fixture.

As can be derived from the depiction in FIG. 5, numerous contact panels 35 are formed on the back surface of the LED board 30, wherein, depending on the operating type of the light fixture 1, it is not necessary for all of the contact panels 35 to be used. This depends on, among other things, whether only one simple switching on and off of the module is provided for, or whether it is intended to provide an individual control thereof. In the depicted exemplary embodiment, only two spring contacts 41 are used, such that the module 20 can thus be supplied with exclusively one suitable supply voltage, or a supply current, respectively, and all of the modules are operated, accordingly, as a unit. A communication, which furthermore would also enable the transmission of error data or suchlike, is not provided for in the depicted exemplary embodiment, wherein, in this case, more of the contact panels 35 would be used, as needed.

Another special feature consists of the fact that—as can be seen in FIG. 5—two rows of contact panels 35 are provided, which are rotated 180° in relation to one another with respect to the longitudinal axis 1 of the lighting module 20. The reason for this measure is that, as a result, there is the possibility of arranging the lighting module 20 selectively in different orientations on the carrier element 5, in particular in two orientations rotated about 180°. This may be useful when the optical elements of the lighting module 20 are designed such that they elicit an asymmetrical light emission, which is stronger in one direction. In this case, it may be provided that the lighting modules 20 disposed on the respective end regions of the carrier element 5 are oriented such that they are rotated in relation to one another, which in turn would elicit a symmetrical light emission by the light fixture 1 when seen as a whole. By arranging two identical contact panels 35, which however are rotated in relation to one another by 180°, a corresponding selective arrangement of the lighting module 20 can be enabled in a simple manner, without having to otherwise modify the arrangement.

It should be noted that, instead of the depicted spring contacts, and the contact panels interacting therewith, plug-in systems can also be used for connecting the lighting module.

Figure 8:
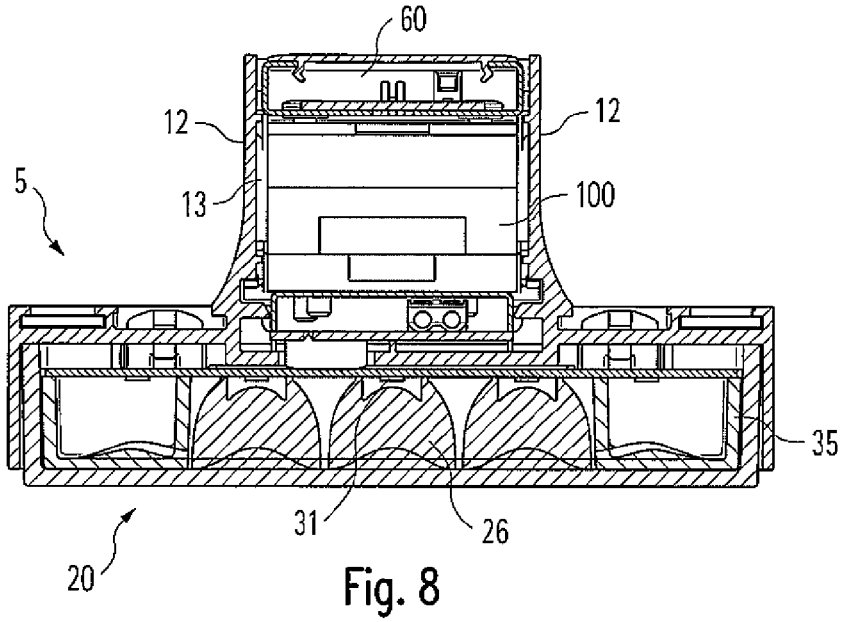
FIG. 8 shows a sectional view corresponding to FIG. 7, wherein here the lighting module is attached to the carrier element.

FIGS. 7 and 8 show, as stated above, a sectional view of the light fixture 1, wherein, first, in FIG. 7 the lighting module 20 is disposed at a spacing to the carrier element 5, and in FIG. 8 it is secured to the carrier element 5. Furthermore, the shape of the carrier element 5 can also be derived from the depictions in FIGS. 7 and 8, wherein it can be seen that this has two side walls 12 running in the longitudinal direction above the U-shaped receiving region 6, which form a narrower second receiving region 13, facing upward and in turn U-shaped.

Figure 3:
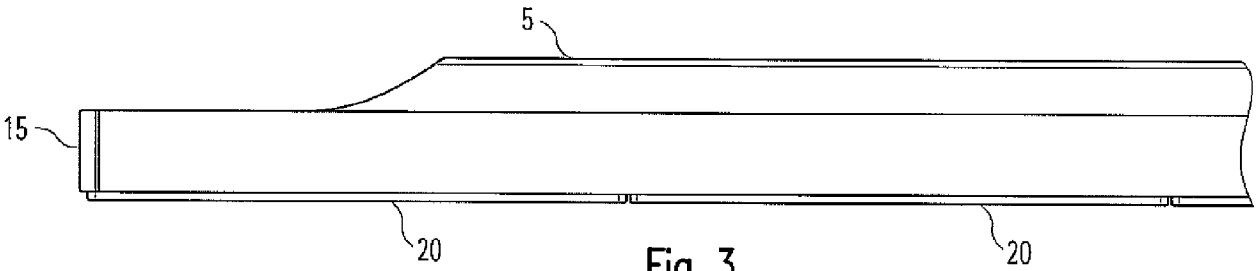
FIG. 3 shows an enlarged side view of the end region of the light fixture.

These side walls 12 can also be easily seen in the depictions in FIGS. 1 to 3, wherein it can also be seen that the walls 12 do not exhibit the same height of the entire length of the light fixture 1. In particular—seen in the longitudinal direction—a slightly raised receiving space **13*a* is formed in the central region of the light fixture 1, which serves to receive the operating device 100 of the light fixture 1, via which the external supply voltage is converted to a suitable operating voltage, or operating current, respectively, for the lighting module 20. Furthermore, an additional lighting unit 60 for generating an indirect light is provided in this central receiving space 13*a*, above the operating device 100. Somewhat lower receiving spaces 13*b* are formed on both sides of this raised central region 13*a***, which can likewise serve to receive further lighting units for generating an indirect light, which, however, shall not be explained in greater detail in the present case.

The present invention is concerned, instead, with special measures, by means of which the electrical connection between the operating device 100 and the spring contacts 41 is ensured, via which the contact to the lighting module 20 is ultimately obtained.

Figure 9:
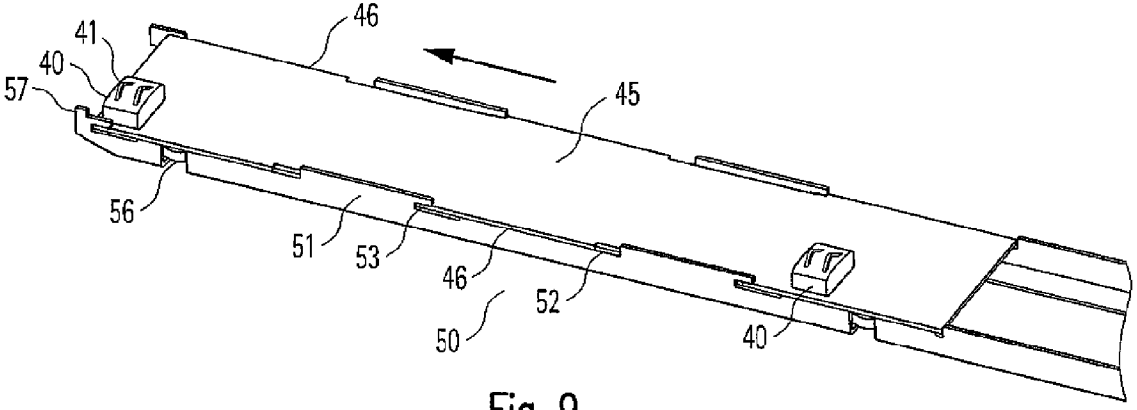
FIGS. 9 and 10 show views of the end region of the device carrier according to the invention.
Figure 10:
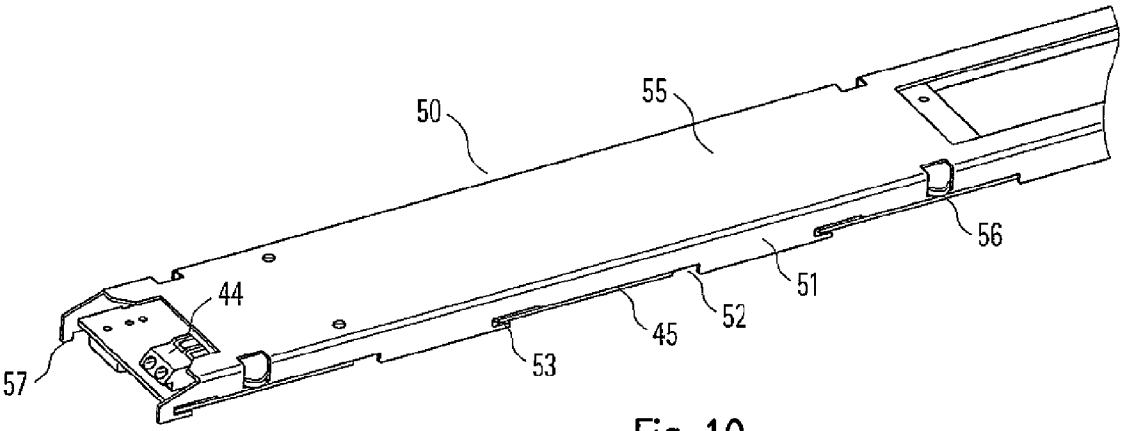

For this, a so-called device carrier 50 is shown in FIGS. 9 and 10, formed by an elongated sheet metal component, which serves as a central retaining element for the components for supplying power to the lighting module 20. The device carrier 50 thus serves, in particular, for retaining the contact blocks 40 having the spring contacts 41, wherein these are not disposed directly on the device carrier 50, but rather, are mounted on connecting boards 45. These connecting boards 45, wherein one of which is depicted in FIG. 9, each have two contact blocks 40 with spring contacts 41, and are designed for establishing contact to two lighting modules 20.

The arrangement of the connecting boards 45 on the device carrier 50 preferably occurs, in turn, without tools, which is achieved in that the boards 45 have longitudinal protrusions 46 on their longitudinal sides. These are provided to connect the boards 45 to the device carrier 50 in the manner of a bayonet locking. The device carrier 50, having a C-shaped cross section, thus has, for this purpose, two elongated side walls 51, in each of which holes 52 are formed, which open into undercuts 53. The connecting boards 45 are then placed on top from above (in accordance with the depiction in FIG. 9), such that the protrusions 46 engage in the holes 52. The boards 45 are subsequently displaced in relation to the device carrier 50 in the direction of the arrow, such that the protrusions 46 engage in the undercuts 53. As a result, the board 45 is securely supported on the device carrier 40, without the need for a tool or additional attachment means. In this manner, numerous connecting boards 45 of this type are disposed on the device carrier 50, wherein, in the present case, half as many boards 45 are needed as the lighting modules 20 that are to be secured to the carrier element 5 for the light fixture 1.

Furthermore, a plug 44 is also disposed on each connecting board 45—the use of a clamp would also be conceivable—which is connected to the contact blocks 40 via conductor paths, which are not depicted in detail. The plug 44 is on the side of the board 45 lying opposite the contact blocks 40, and is connected to the operating device 100 via cables. In this manner, the electrical connection between the operating device 100 and the contact blocks 40 is thus ensured.

Figure 11:
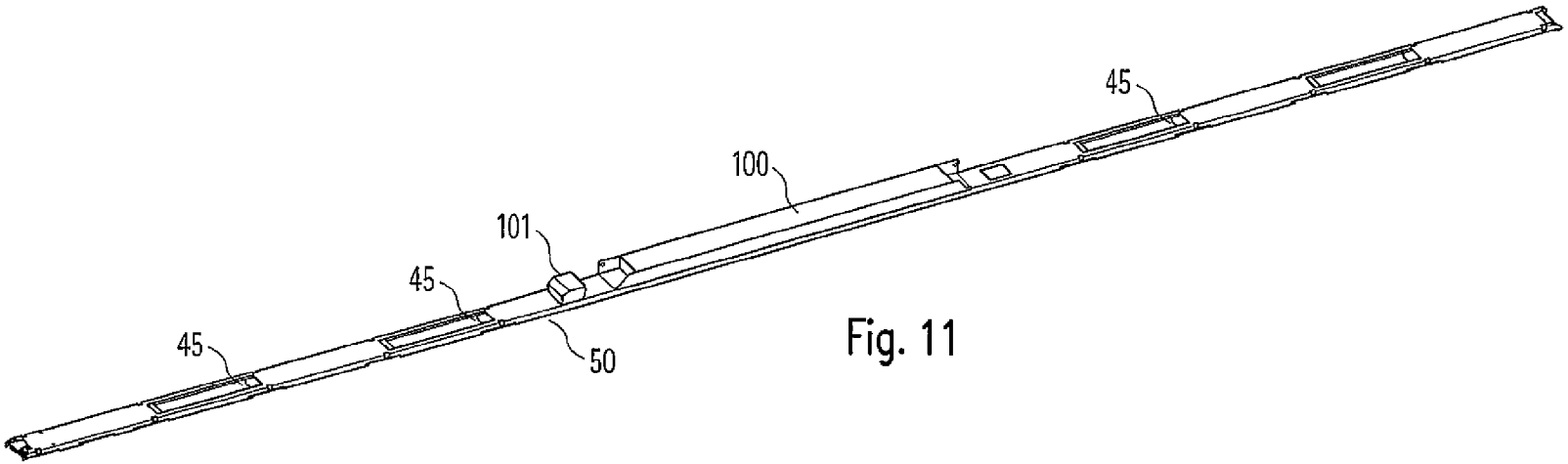
FIG. 11 shows a perspective view of the entire device carrier.

FIG. 11 shows an entire device carrier 50 having the connecting boards 45 disposed on the undersurface, as well as the operating device 100 disposed on the opposite side. There is also a clamp 101 disposed on the side having the operating device 100, via which the connection to the external current supply lines is obtained.

As has already been stated, the connection between the operating device 100 and the connecting boards 45 is obtained by means of cables, wherein for this, a cable harness is preferably used, which has electrical lines that are connected at one end to the operating device 100 and at the other end to the connecting boards 45, specifically with plugs 44 in the connecting boards 45. The cables of the cable harness (not shown) are adjusted thereby to the spacing between the operating device 100 and the connecting boards 45, such that there is no excess cable. Instead, the cables are preferably laid in the intermediate region between the base surface 55 of the device carrier 50 and the connecting boards 45, such that ultimately an orderly component is obtained, as is depicted in FIG. 11. This contains all of the substantial components for supplying power to the lighting module 20, and can then be secured to the carrier element 5 for the light fixture 1 in a simple manner.

The attachment of the device carrier 50 occurs, in turn, preferably without tools, wherein for this, in particular, a locking in place is provided for. This is achieved in that convex nubs 56 are formed on the side walls 51 of the device carrier 50, as can be seen in particular in FIG. 10. The device carrier 50 is then locked in place on the carrier element 5 for the light fixture 1 using these nubs 56. This is achieved in that the device carrier 50 is placed in the open upper receiving region 13 of the carrier element 5 from above, and pushed toward the bottom, until the convex nubs 56 engage with corresponding inward projections 15 of the aluminum profile, which aluminum profile forms the carrier element 5. By means of a guide lug 57, which is formed on an end surface end of the device carrier 50, and engages in a hole in the device carrier 5, it is ensured that the device carrier 50 is placed in the carrier element 5 such that it is positioned and oriented correctly.

Figure 12:
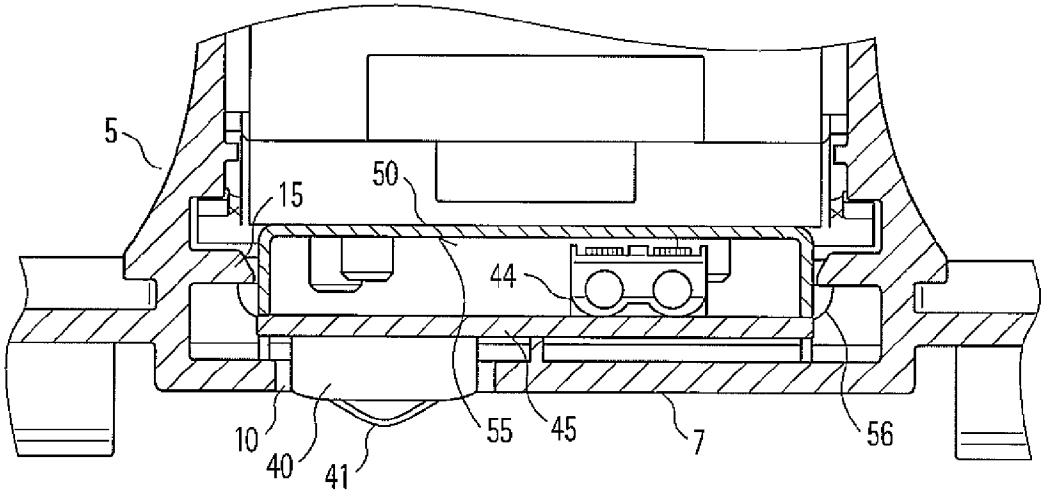
FIG. 12 shows and enlarged sectional view illustrating the detachable securing of the device carrier to the carrier element for the light fixture.

The locking in place feature can be seen easily from the enlarged depiction in FIG. 12, which shows the arrangement of the device carrier 50 in the carrier element 5. The intermediate space between the base surface 55 of the device carrier and the connecting boards 45 can also be seen, which is used for guiding the electric lines (not shown) of the cable harness, and in which the plugs, or connectors 44, respectively, are also located. The manner in which the contact blocks 45 with the spring contacts 41 pass through the holes 10 in the base surface 6 of the lower receiving space, such that they are accessible to the contacting areas 35 of the light fixture, can also be seen therein.

Ultimately, by means of the special design of the device carrier according to the invention, a very modular construction is thus obtained for the light fixture on the whole. The individual components can be very quickly and easily mounted on the carrier element for the light fixture as prefabricated components, and in particular, can be secured thereto without tools, such that, on one hand, the assembly of the light fixture is simplified, and in particular, maintenance can be easily carried out.

What is claimed is:

1. A light fixture (1), having an elongated carrier element (5), the elongated carrier element (5) having a first receiving region (13) and a second receiving region (6) separated by at least a base surface (7) in the elongated carrier element (5);

numerous lighting modules (20), which can be detachably secured to the elongated carrier element (5) in the second receiving region (6), a device carrier (50), which can be detachably secured to the elongated carrier element (5) in the first receiving region; and means for providing the lighting modules (20) with power, comprising an operating device (100) and contacting means (40, 41) connected to the operating device, wherein the operating device (100) and the contacting means (40, 41) are disposed on the device carrier (50);

wherein the device carrier (50) is disposed in the first receiving region (13) on the side of the elongated carrier element (5) facing away from the second receiving region (6) in which the lighting modules (20) are disposed, each of said LED modules (20) comprising an LED board (30), numerous LEDs (31) and electrical contact panels (35) on the respective LED board (30), wherein the contacting means (40, 41) on the device carrier (50) pass through holes (10) formed in the elongated carrier element (5) in order to make electrical contact with electrical contact panels (35) on the respective LED board (30).

2. The light fixture according to claim 1, characterized in that the contacting means have spring contacts (41).

3. The light fixture according to claim 1, characterized in that the contacting means (40, 41) are disposed on connecting boards (45), which can be detachably secured to the device carrier (50).

4. The light fixture according to claim 3, characterized in that a plug (44) is disposed on each of the connecting boards (45), which is connected at one end to the contacting means (40, 41) and at the other end to the operating device (100).

5. The light fixture according to claim 4, characterized in that the connection between the plug (44) and the operating device (100) occurs via cables.

6. The light fixture according to claim 5, characterized in that the connection of the plugs (44) on all of the connecting boards (45) to the operating device (100) occurs via a cable harness, the individual cables of which are each adjusted to the spacing between the plug (44) and the operating device (100).

7. The light fixture according to claim 5, characterized in that the cables are laid in an intermediate space between the device carrier (50) and the connecting boards (45) held in the device carrier (50).

8. The light fixture according to claim 3, characterized in that contacting means (40, 41) for two lighting modules (20) are provided in each case on each of the connecting boards (45).

9. The light fixture according to claim 1, characterized in that the device carrier (50) can be locked onto the elongated carrier element (5).

* * * * *